United States Patent [19]

Maul et al.

[11] 4,059,051

[45] Nov. 22, 1977

[54] DATA RECORDER WITH PORTABLE CARTRIDGE

[75] Inventors: John A. Maul, Lyndhurst; Richard E. Valentine, Mentor, both of Ohio

[73] Assignee: Addressograph Multigraph Corporation, Cleveland, Ohio

[21] Appl. No.: 494,071

[22] Filed: Aug. 2, 1974

[51] Int. Cl.[2] ..... B41F 3/04

[52] U.S. Cl. ..... 101/45; 101/56; 101/272

[58] Field of Search ..... 101/45, 56, 269, 272; 242/71.2, 71.6, 54, 55

[56] References Cited

U.S. PATENT DOCUMENTS

| | | | |
|---|---|---|---|
| 2,854,921 | 10/1958 | Frankie et al. | 101/56 |
| 3,203,348 | 8/1965 | Ellis | 101/272 |
| 3,236,177 | 2/1966 | Perry, Jr. et al. | 101/269 |
| 3,368,333 | 2/1968 | Merklin | 242/55 X |
| 3,447,457 | 6/1969 | Dechert, Jr. et al. | 101/269 |
| 3,614,012 | 10/1971 | Edelman et al. | 242/55 X |
| 3,673,960 | 7/1972 | Ricci et al. | 101/269 |
| 3,762,316 | 10/1973 | Spradlin | 101/45 |
| 3,945,316 | 3/1976 | Thomson | 101/45 |

*Primary Examiner*—Paul E. Shapiro
*Attorney, Agent, or Firm*—Harry M. Fleck, Jr.

[57] ABSTRACT

A data recorder is provided including a removable cartridge which carries both a sales form and an underlying log sheet. The fixed and variable data are imprinted by reciprocation of a platen carriage, with return of the carriage to the home position causing ejection of the credit card and loading of a stored energy mechanism. When the sales form is removed, the stored energy mechanism is released, whereby the log sheet is incrementally advanced to the next position.

26 Claims, 13 Drawing Figures

REFILL

DATA RECORDER WITH PORTABLE CARTRIDGE

BACKGROUND OF THE INVENTION

The present invention is generally related to data recorders and more particularly to an improved data recording apparatus including a removable, portable field board or cartridge.

In the past, various data recording devices have been proposed or manufactured to provide printed records of sales transactions, particularly those involving the use of credit cards. Typically, such conventional recorders imprint embossed information from the credit card and from settable print wheels bearing, for example, the date and amount of the transaction. The imprint is made by way of a roller platen which is passed over a formset, bearing carbon inserts or the like. Most formsets provide multiple copies, one of which is given to the customer, another to the vendor, and a third is sent to a processing station.

In recent years, there has been a significant increase in the volume of credit transactions such that many central billing offices have been faced with the problem of efficiently processing the credit transaction data at a reasonable cost. When utilizing the conventional formsets, each transaction initiates a single data form for accounting and billing. This requires that hundreds of thousands of data forms developed daily must be separated, categorized, microfilmed and the data therefrom processed and ultimately printed onto each customer's monthly statement. This process has become so complex that the expense is becoming prohibitive.

In an effort to reduce such costs, it has been found desirable to record the data on separate lines of a log sheet. Each line is provided with a space for the customer's signature, which becomes a part of the permanent record. This also provides the data in a format allowing optical scanning which significantly reduces the complexity and cost of processing each transaction.

One such a log type recording machine is disclosed in U.S. Pat. No. 3,762,316 to Spradlin. In the Spradlin machine, the log sheet is rolled up and incorporated into the base of the data recorder permanently located at a service desk or counter where the customer signs the log sheet when making a purchase. Thus, when this arrangement is used for gasoline credit transactions, it is necessary for the customer to leave his vehicle to record his signature.

Therefore, it is a primary object of the present invention to provide a data recording apparatus including a removable cartridge or field board which is portable in nature such that it may be conveniently carried to a customer for his signature.

Another object of the present invention is to provide a novel portable data recorder cartridge which carries a transaction log sheet and sales form and which includes means for incrementally advancing the log sheet in response to removal of the sales form after signing.

It is a further object of the present invention to provide a unique transaction log cartridge including means for conveniently loading and indexing a log sheet, whereby the first information area to be printed is brought into the proper alignment with the print area.

Still another object of the present invention is to provide a versatile data recorder with means for receiving a credit card for imprinting embossed data therefrom and means for automatically ejecting the card in response to completion of the imprint operation.

It is yet another object of the present invention to provide a novel transaction log data recorder including a lockout mechanism which prevents inadvertent insertion of a credit card and operation of the recorder in the absence of a log sheet in the print area.

Still a further object of the present invention is to provide a portable transaction log cartridge which is of relatively simple construction, yet highly versatile, durable, longlasting, and inexpensive to manufacture and maintain.

SUMMARY OF THE INVENTION

In accordance with the present invention there is provided a data recording apparatus with a removable, portable cartridge including several features which provide extremely convenient operation of the recorder. The cartridge includes means which permits log sheets to be easily loaded and automatically indexed whereby proper alignment with the print area is assured.

When utilizing the cartridge to record a typical transaction, a credit card is inserted into a receiving slot underlying the log sheet for transferring embossed data thereto. A sales form is placed in overlying relation with the log sheet. Preferably, a roller platen carriage is provided which is reciporacted to effect the imprint. As the carriage is returned to its home position, it causes ejection of the credit card and at the same time loads a spring, or other energy storage device, associated with the log advance mechanism.

After imprint, the cartridge is removed and presented to the customer together with his credit card. The customer signs the sales form previously mounted to the cartridge to provide a signature record on both the sales form and underlying log sheet. The form is then removed from the cartridge and, typically, one of the form sheets is presented to the customer as a receipt. Removal of the sales form releases the previously loaded advance mechanism, whereby the log sheet is advanced to the next position.

The above described sequence of operation is repeated for each imprint until the log sheet information areas have been used, at which time a card lockout mechanism becomes effective to prevent further use of the machine until a new log sheet has been loaded into the cartridge.

DESCRIPTION OF THE PREFERRED EMBODIMENT

Figure 1:
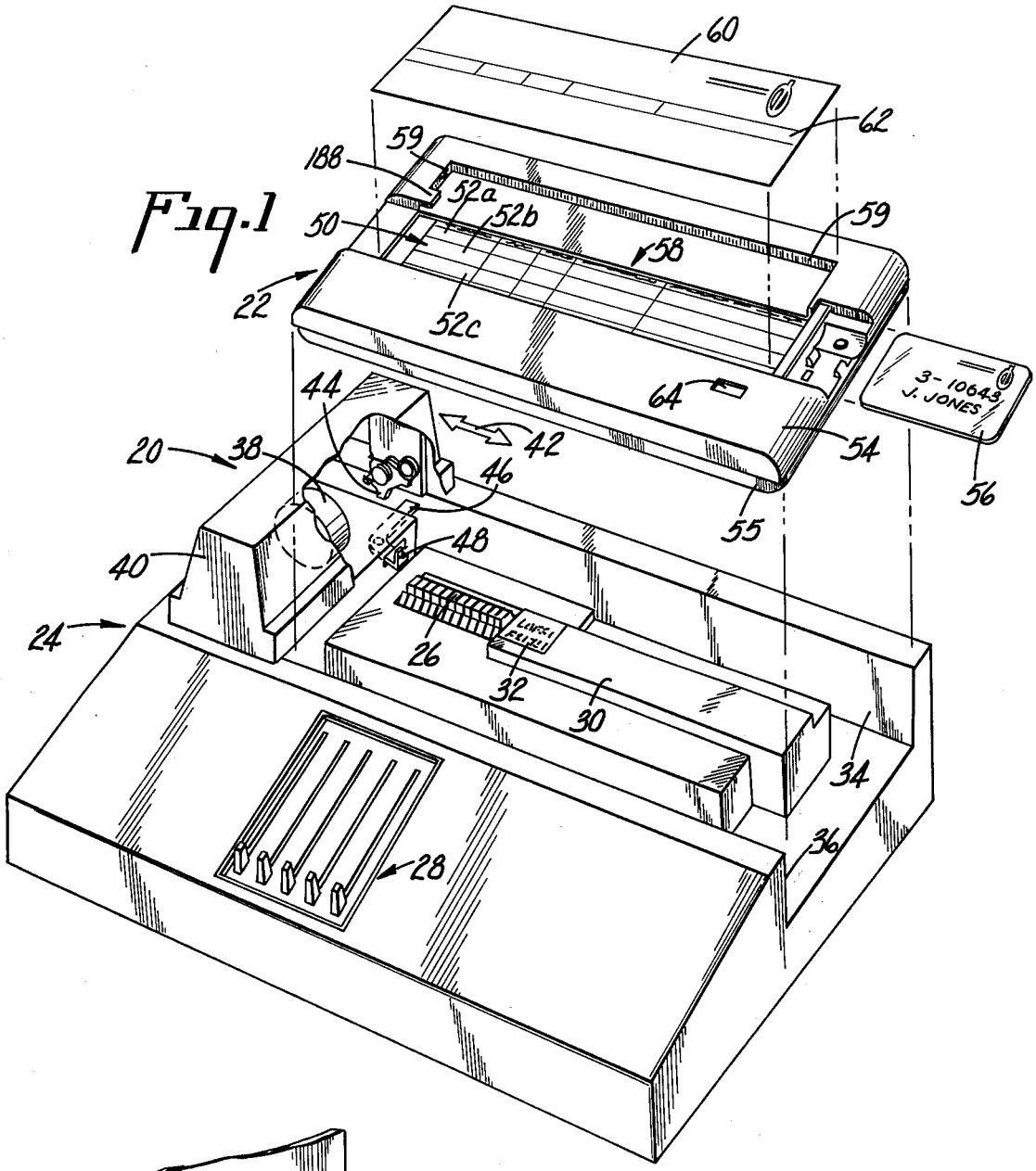
FIG. 1 is an exploded perspective view of the data recorder and removable cartridge of the present invention with sections removed.
Figure 2:
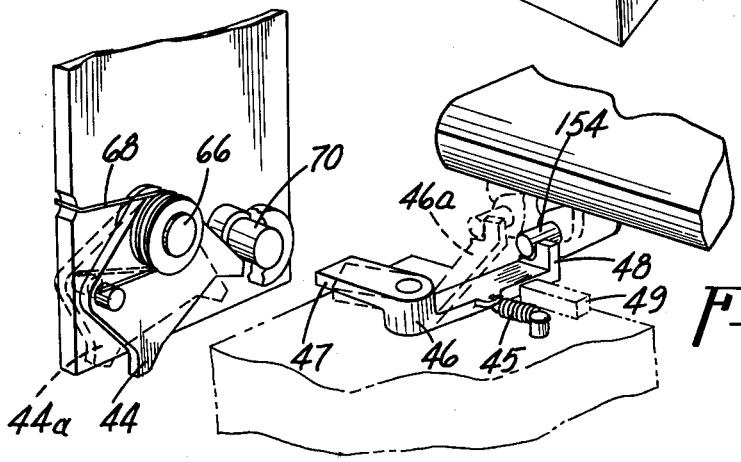
FIG. 2 is an enlarged partial perspective view of the linkage interconnecting the platen carriage with the cartridge to effect operation of the advancement mechanism.

Referring now, more particularly, to FIGS. 1 and 2 of the drawings, the data recorder of the present invention is generally indicated by the numeral 20 and includes a removable cartridge 22 adapted to be mounted on an imprinter 24 which is utilized to effect an imprint operation in conventional manner. Preferably, the imprinter includes a plurality of imprint wheels 26, at least some of which are positioned by set-up keys 28 coupled to the wheels by appropriate linkages, not illustrated. An elongated print bed 30 which is provided in general alignment with print wheels 26. Preferably, the print bed accommodates an identification plate 32 bearing fixed embossed data such as that which identifies the vendor, location, etc.

Prior to each imprint operation, cartridge 22 is mated with imprinter 24 and held in position by vertical side walls 34 and 36 which cooperate with correspondingly shaped side surfaces of the cartridge to prevent movement thereof during the imprint operation. The underside of cartridge 22 is provided with an appropriate opening which is brought into general alignment with bed 30 and imprint wheels 26 when the cartridge is mounted in place, as herein after explained. Preferably, the imprinter 24 includes a roller platen 38, mounted in a carriage 40 by appropriate means, not illustrated. Platen carriage 40 is mounted to allow reciprocation along a path indicated by the arrow at 42. The roller platen may be of the "shifting" type such as that disclosed in U.S. Pat. No. 3,577,917 to Nantz, assigned to the assignee as the present application. The shifting platen allows the imprinting of separate areas of data on the forward and return strokes of the platen carriage. Of course, it is not intended that the present invention be limited to data recorders utilizing shifting platen, as various platen arrangements may be used dependent upon the specific applications. Platen carriage 40 is also provided with a motion transfer pawl 44 which is effective to operate lever 46 upon return of the carriage to its home position, as hereinafter explained.

As mentioned above, cartridge 22 carries an elongated log or record sheet generally indicated by the numeral 50 including a plurality of transversely extending record or information areas as indicated at 52*a*, 52*b*, and 52*c*. In a typical application, each information area is intended to record a single transaction and includes data, such as amount and date, from print wheels 26 together with data from plate 32. Cartridge 22 includes a hinged lid or cover 54 which is adapted to receive a credit card or the like 56 bearing embossed information such as account number and the card holder's name. When a card is inserted into the cartridge, as hereinafter explained, at least a portion of the embossed data thereon underlies the information area of the log sheet 50 to be imprinted. Lid 54 is also provided with a generaly rectangular opening 58 which exposes several lines of the log sheet 50. A rectangular window or opening 64 is provided in lid 54 in overlying relationship with a hidden portion of log sheet 50. When the last information area on the log sheet has been imprinted, a "Refill" indicator appears in a window 64 to alert the operator to reload the cartridge, as hereinafter explained.

It will be appreciated that cartridge lid 54 is also provided with gage surfaces 59 for receiving a generally rectangular sales form or formset 60 which overlies the exposed portion of log sheet 50. Preferably, formset 60 includes several sheets with carbons therebetween, whereby multiple copies of the imprinted information are provided. An elongated information area 62 aligns with the information area of log sheet 50 to be printed in this case area 52*a*. The underside of the lower most sheet of formset 60 is provided with carbon, or other pressure transfer material, along the information area. This carbon is transferred to effect recordation of the imprinted information onto record area 52*a* of the log sheet. In the embodiment illustrated, this information is imprinted on the forward stroke of the carriage. On the return stroke, roller platen 38 is shifted beyond the bounds of information area 52*a* and carbon area of formset 60 to effect the imprinting of other information onto the formset 60 without imprinting on the log sheet 50.

With particular reference to FIG. 2, it will be appreciated that motion transfer pawl 44 is pivotally mounted for movement about a pin 66 associated with the platen carriage frame. A torsion spring 68 is provided which normally biases pawl 44 in a counterclockwise direction into engagement with a stop member 70. Lever 46 is pivotally mounted to the base or frame of the imprinter and includes an operating portion 48 which protrudes through an opening in the imprinter base. A spring 45 normally biases lever 46 against a stop member 49. A finger 47 associated with lever 46 normally lies in the path of the lower portion of pawl 44. On forward stroke of carriage 40, pawl 44 is rocked upwardly to a position indicated at 44a upon engagement with lever 46. Upon return of the platen carriage to its home position, pawl 44 positively engages portion 47 of lever 46 thereby pivoting such to a position indicated at 46a in FIG. 2. During this operation, portion 48 of lever 46 loads the log advance mechanism, hereinafter described in more detail.

Figures 3, 3A:
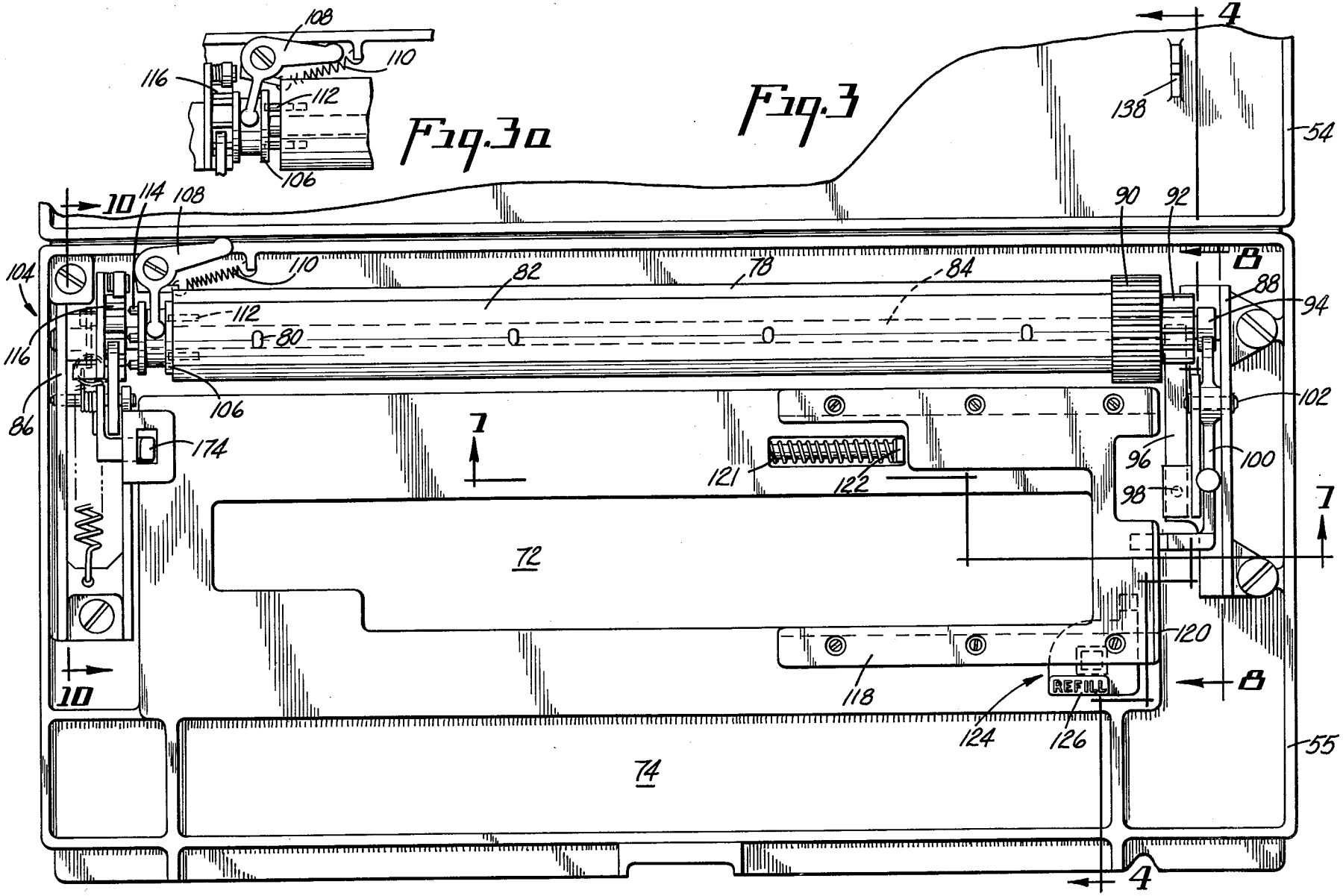
FIG. 3 is a top plan view of the cartridge of the present invention with the lid partially shown in an opened position.
FIG. 3a is a top plan view of the clutch mechanism in an engaged position with the lid closed.

Referring now, more paticularly, to FIG. 3, several structural features of the cartridge may be seen in more detail. The cartridge is provided with a lower frame or housing 55 which includes a generally rectangular opening 72. When the cartridge is mounted in place, print wheels 26 protrude upwardly through opening 72 to cooperate with roller platen 38. The log sheet when mounted extends between a supply location 74 and a take-up spool 78. The take-up spool is provided with a plurality of mounting pins or fingers 80 which reside in a flat area 82 extending along the length of the spool.

These pins cooperate with openings in one end of the log sheet, whereby a rotation of the spool pulls the log sheet to advance such from its supply location. Take-up spool 78 is rotatably mounted to a support shaft 84 supported for rotation at its opposite ends by mounting brackets 86 and 88. A thumb wheel 90 and indexing gear 92 are attached to one end of the take-up spool for rotation therewith. Shaft 84 passes through thumb wheel 90 and gear 92 and carries a card eject cam 94 near its right end. Cam 94 is keyed or otherwise affixed to shaft 84 for rotation therewith. A leaf spring lever 96 is mounted to frame 55 at 98 and cooperates with gear 92 to define an index stop, as hereinafter explained. A card release lever 100 is pivotally mounted to the frame at 102 such that one end cooperates with cam 94 and the opposite end cooperates with a credit card inserted into the machine, as hereinafter explained.

A log sheet advance mechanism generally indicated by the numeral 104 is located at the left end of shaft 84 and serves to step advance spool 78 through clutch member 106. As shown in FIG. 3, clutch member 106 is disengaged from the advance mechanism 104 under the influence of a shift lever 108 which is biased in a counterclockwise direction under the influence of a tension spring 110. A pair of sliding keys 112 are attached to clutch member 106 and cooperate with correspondingly shaped keyways formed in spool 78 to transmit rotation thereto. A plurality of fingers 114 protrude from the left side of clutch member 106 and cooperate with holes formed in the side of an advance gear 116. With lid 54 open, control lever 108 assumes the position illustrated in FIG. 3, wherein clutch member 106 is disengaged and takeup spool 78 is free to rotate a pre-determined angular distance for loading and properly indexing a log sheet. FIG. 3*a* illustrates that the positions of lever 108 and clutch member 106 when lid 54 is closed. In this condition, clutch fingers 114 operatively engage advance gear 116 such that the take-up spool and advance gear move in unison.

A generally U-shaped mounting plate 118 is attached to frame 55 to define a card receiving slot of generally rectangular configuration. Preferably, the outer edge of plate 118 is flaired or turned upwardly as indicated at 120 to aid in the insertion of cards. The frame is also provided with a generally rectangular opening 121 located within the card receiving area and accommodating a card eject member 122 which protrudes upwardly from the underside of frame 55. The end of the eject member is influenced to the left during card insertion. After each imprint operation, finger 122 serves to eject the card, as hereinafter explained. A card lock-out mechanism generally indicated by the numeral 124 is also mounted to frame 55 and includes a combination "Refill" indicator and sensor 126 which appears in window 64 after the last line of the log sheet has been printed.

Figure 4:
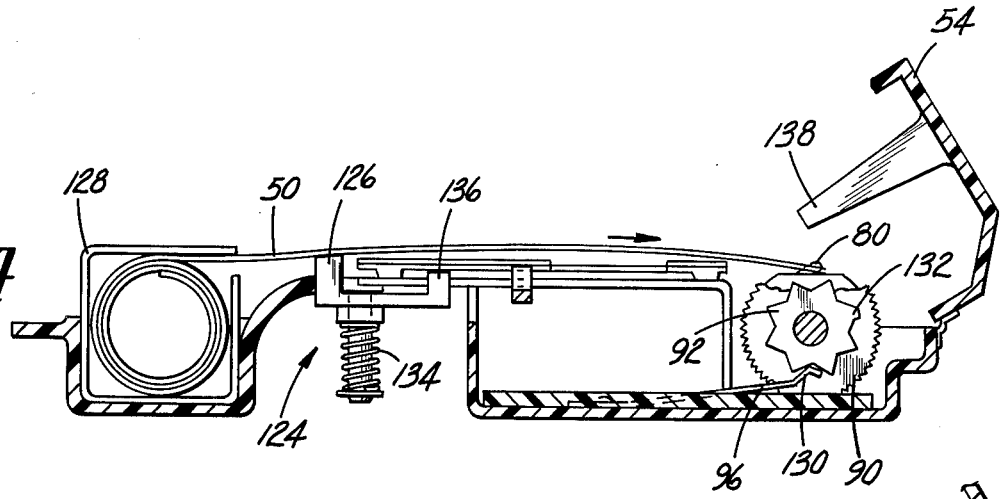
FIG. 4 is a view of the cartridge taken along section 4—4 of FIG. 3, but with a log sheet partially installed prior to indexing thereof.
Figure 5:
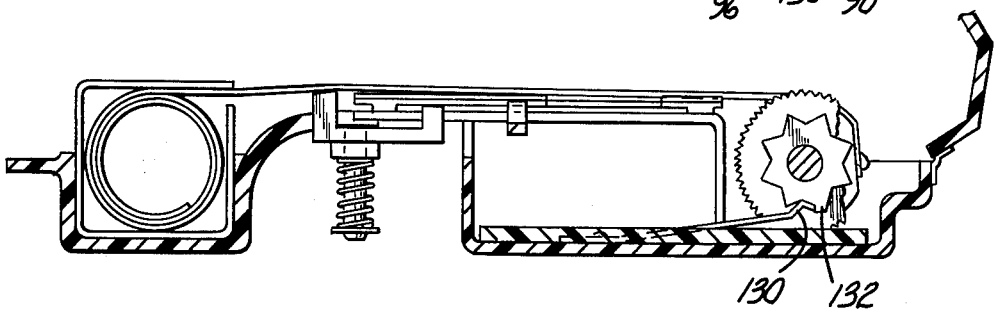
FIG. 5 is a view similar to FIG. 4, but with the log sheet advanced to the initial index position.
Figure 6:
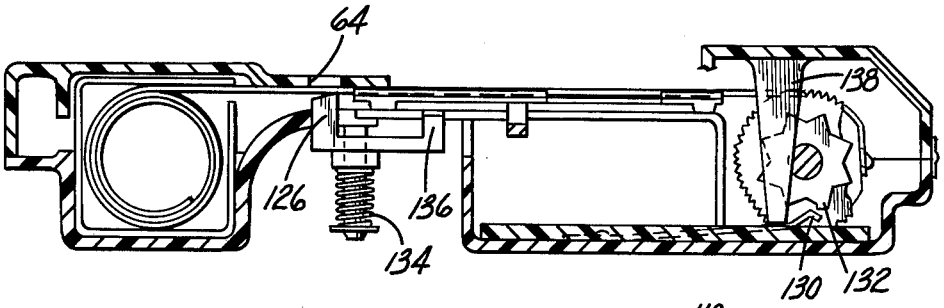
FIG. 6 is a view similar to FIG. 5, but with the cartridge lid closed and the index stop member disengaged.

Referring now to FIGS. 4–6, the detailed structure and operation of the log sheet indexer may be more clearly understood. When loading a log sheet, holes in the leading edge are fitted over pins 80 on the take-up spool. Preferably, the log sheet is rolled up in a supply container, such as that indicated at 128, with the container being placed in the supply location 74 provided in the cartridge frame. Index gear 92 includes a plurality of teeth defining circumferentially spaced detent surfaces which cooperate with a similarly shaped end portion 130 of leaf spring 96. One of the teeth includes a stop portion 132 which prevents further clockwise rotation of the take-up spool upon engagement with the end of leaf spring portion 130.

In order to achieve indexing, thumb wheel 90 is manually rotated in a clockwise direction. When stop 132 engages the end of leaf spring portion 130, the thumb wheel and take-up spool are prevented against further clockwise rotation. The distance between the leading edge of th log sheet and first information area is such that when the take-up spool is rotated to the index position, the first information area is in proper position for imprinting. With the log sheet in this position, the lid is then closed whereby an index release finger 138 carried by lid 54 depresses a leaf spring 96 in a downward direction thereby disengaging as such from stop 132. This frees the take-up spool for rotation under control of the advance mechanism. As mentioned above, during closure of lid 54, the take-up spool is drivingly connected to the advance mechanism through engagement of clutch member 106 with advance gear 116, as illustrated in FIG. 3*a*. A card lock-out mechanism 124 includes a coil compression spring 134 which normally biases the log sheet sensor and indicator member 126 in an upward direction. A card lock-out finger 136 is connected to, or integral with, member 126 for movement therewith and blocks the entranceway to the card receiving slot unless a log sheet is sensed and the cartridge lid is in a closed position. It will be observed from FIG. 6 that upon closure, the lid in the area of window 64 presses the log sheet downwardly against sensor 126. This lowers lock-out finger 136 to a position which allows insertion of a card into the slot opening. This operation compresses coil spring 134, such that sensor 126 presses upwardly slightly against the log sheet in the area of window 64. As such, when the log sheet is advanced to the point where the trailing edge passes sensor 126, the sensor springs upwardly into the area of window 64 to display the "Refill" indicator to the operator. At the same time locking out finger blocks the entranceway to the card receiving slot.

Figure 7:
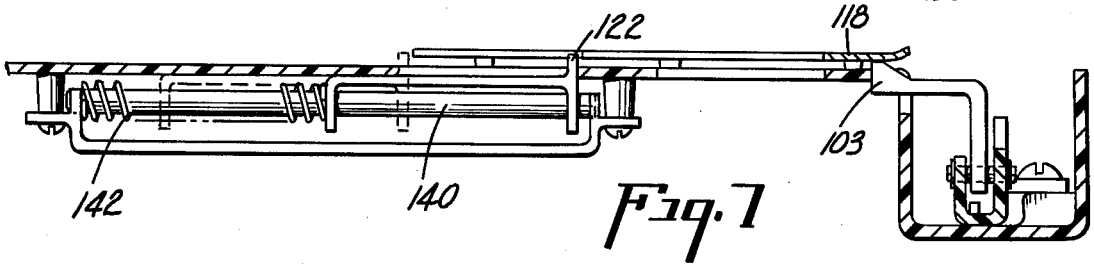
FIG. 7 is a view taken generally along section 7—7 of FIG. 3 showing the card eject mechanism in the extended position, with a phantom view of such in the retracted position.
Figure 8:
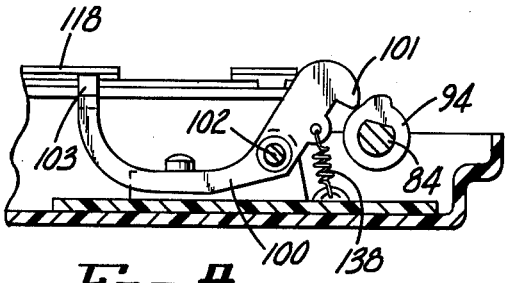
FIG. 8 is a view taken substantially along section 8—8 of FIG. 3 showing the card release lever in closed position.
Figure 9:
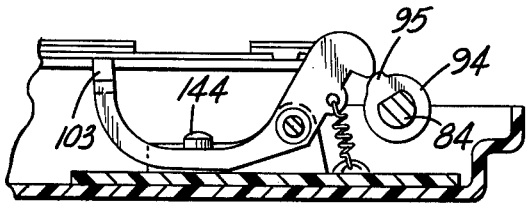
FIG. 9 is a view similar to FIG. 8, but with the card release lever in an open position.

With reference to FIG. 7–9, operation of the card eject mechanism may be more fully understood. Control lever 100 of the eject mechanism includes a cam follower portion 101 which is held in engagement with cam 94 under the influence of a coil tension spring 138. The opposite end portion 103 of the lever is provided with an upwardly sloped surface terminating at a point in engagement with the underside of plate 118. During card insertion, end 103 is influenced downwardly by the leading edge of the card, thereby permitting the card to be fully inserted into the receiving slot. As the card is inserted, it is brought into engagement with eject member 122 which is slidably mounted to a stationary shaft 140 carrying a coil compression spring 142. Movement of eject member 122 by the card upon insertion causes compression of spring 142. When the card is fully inserted, lever 100 returns to its original position under the influence of spring 138. This retains the card in place and prevents the ejection of such under the influence of spring 142.

Cam 94 is provided with a lob 95 which cooperates with cam follower 101 to pivot lever 100 in a counterclockwise direction to the position illustrated in FIG. 9. This lowers end portion 103 sufficiently to allow the previously inserted card to be ejected under the influence of eject member 122 and associated coil compression spring 142. This operation is effected through a rotation of shaft 84 when the log advance mechanism is preloaded, as hereinafter described. It will also be appreciated that lever 100 preferably is provided with a manual eject button 144 which may be depressed to effect card ejection independently of loading of the advance mechanism.

Figure 10:
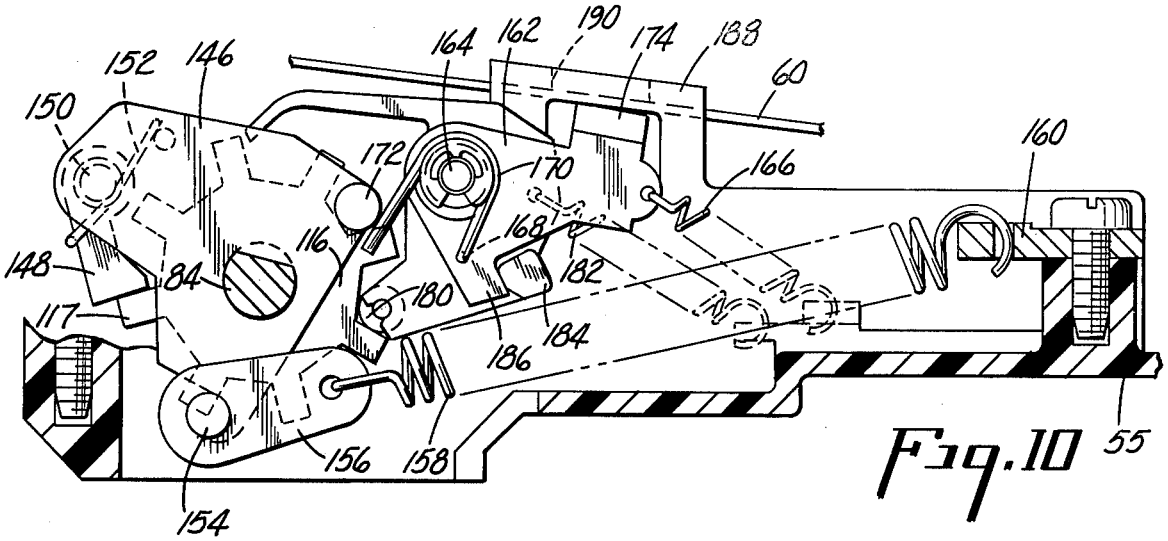
FIG. 10 is a view of the log advance mechanism taken along section 10—10 of FIG. 3 with the mechanism in a loaded condition and a sales form mounted in place.
Figure 11:
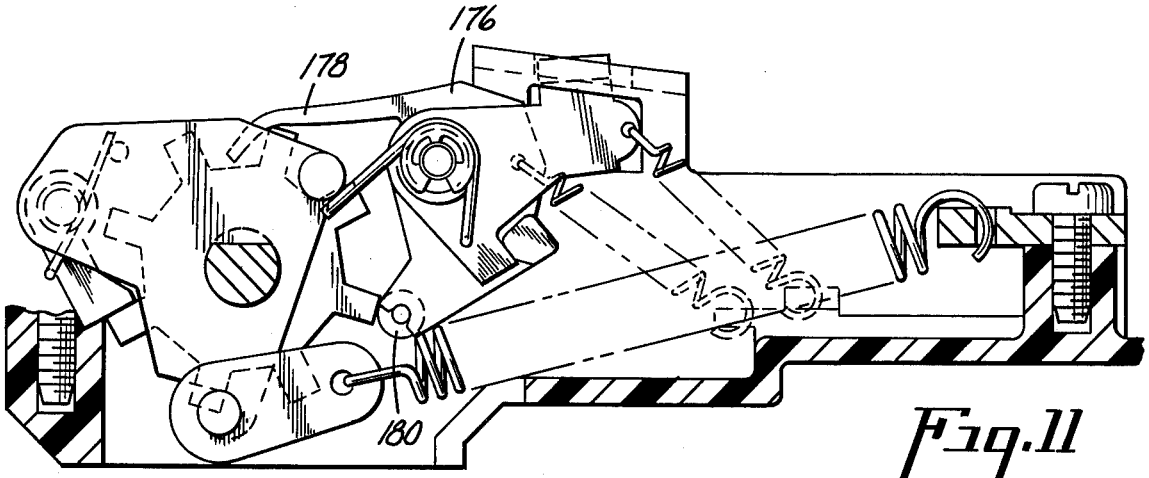
FIG. 11 is a view of the advance mechanism similar to FIG. 10, but illustrating the mechanism as it is being advanced subsequent to removal of the sales form.
Figure 12:
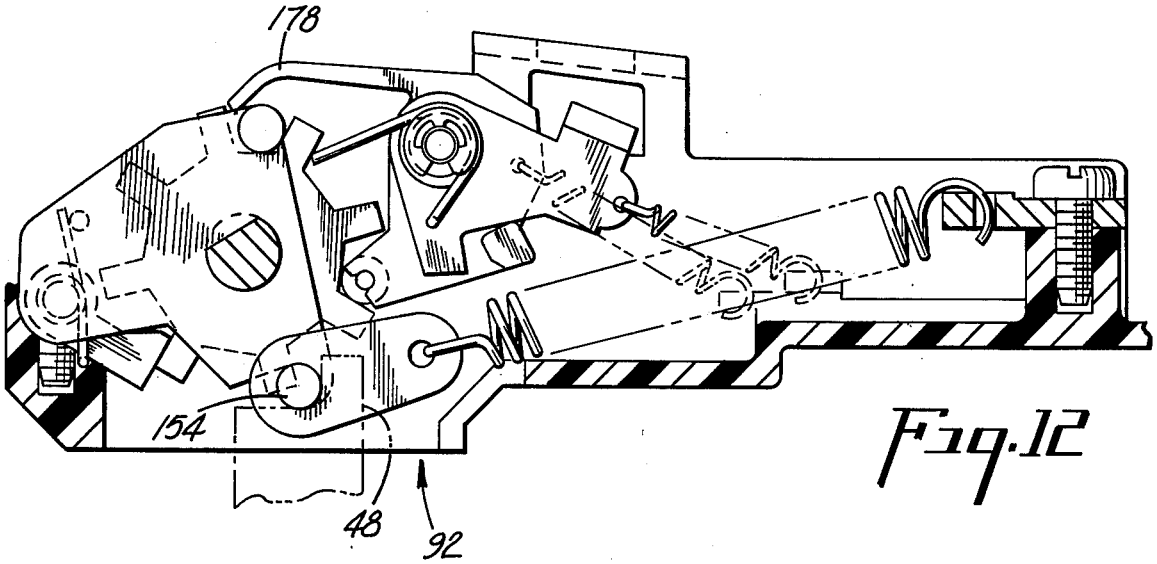
FIG. 12 is a view similar to FIG. 11, but with the mechanism at rest upon completion of an advance step and with phantom view of the actuation lever.

Referring now, more particularly, to FIGS. 10–12, the structure of the log advance mechanism may be seen in more detail. It should be noted while these correspond to views taken along section 10—10 of FIG. 3, the various operational positions of the mechanism require the engagement of clutch 106 such as is illustrated in FIG. 3a. FIG. 10 illustrates the advance mechanism in a loaded condition with a formset 60 mounted in position. FIG. 11 shows the mechanism during a step advance. FIG. 12 illustrates the advance mechanism at rest upon completion of a step advance, but prior to preload. As mentioned above, the take-up spool is advanced through movement of advance gear 116 which is rotatably mounted to shaft 84. Preferably, gear 116 is provided with a plurality of circumferentially spaced teeth 117, each of generally rectangular configuration. A drive lever 146 is mounted to shaft 84 for rotation therewith. A drive pawl 148 is mounted to pivot pin 150 affixed to lever 147 and is biased in a counterclockwise direction by a torsion spring 152. When drive lever 146 is pivoted in a counterclockwise direction, drive pawl 140 engages one of the gear teeth to drive the gear in a counterclockwise direction, thereby advancing the log sheet a predetermined distance to the position illustrated in FIG. 12.

The lower end of drive lever 146 carries an actuation pin 154 which extends through a hole in link member 156. A coil tension spring 158 extends between link 156 and a mounting 160 fastened to frame 55. A form sensing lever 162 is pivotally mounted to a stationary shaft 164 associated with frame 55. A coil tension spring 166 extends between one end of lever 162 and frame 55 to influence the lever in a clockwise direction toward arrest position illustrated in FIG. 12. Lever 162 is provided with a hole 168 or other fastening means which secures at one end of a torsion spring 170 mounted about shaft 164. The opposite end of the torsion spring is engaged by a pin 172 carried by drive lever 146 when such is in the loaded position. This imparts a counterclockwise torque to sensing lever 162. A finger 174 associated with lever 162 presses upwardly against the bottom of the formset 60 when the advance mechanism is loaded.

The advance mechanism is further provided with an escapement member 176 which is pivotally mounted to shaft 164 adjacent lever 162. The escapement includes a resilient finger 178 which cooperates with the teeth of advance gear 116. The lower side of escapement carries a roller 180 which also cooperates with the gear teeth to limit each advancement to a single gear tooth. A tension spring 182 extends between escapement member 176 and frame 55 to bias the escapement member in a clockwise direction and influence roller 180 into the space separating adjacent gear teeth during the advancement operation. Escapement 176 is also provided with a protruding portion 184 which is engaged by an oppositely disposed portion 186 carried by sensing lever 162.

When the advance mechanism is loaded and formset 60 is in place, as illustrated in FIG. 10, torsion spring 170 imparts a counterclockwise torque to sensing lever 162, whereby the associted sensing finger 174 presses upwardly against the bottom of the formset. This torque is created through the engagement of pin 172 with torsion spring 170 and is of greater magnitude than the clockwise torque created by tension spring 166. End bracket 86 includes an upwardly extending portion 188 which partially overhangs the edge of formset 60 and includes a sensor hole 190 in general alignment with sensing 174. When the formset is removed, sensing finger 174 moves in an upward direction through hole 190 as illustrated in FIG. 11. Roller 180, which normally prevents counterclockwise rotation of advancement gear 116, is shifted radially outward freeing the gear and associated take-up spool for rotation. When the sensing lever is released, a counterclockwise torque is imparted to escapement member 176 through abutting portions 184 and 186. This action retracts roller 180 to allow a rotation of the advancement gear. During this movement, one of the gear teeth engages resilient finger 178, thereby creating a clockwise torque on escapement 176 which together with spring 182 influences roller 180 into the space separating the next set of gear teeth. This intermediate position is best illustrated in FIG. 11. As drive pawl 148 continues to rotate the advancement gear, pin 172 disengages torque spring 170, whereby the sensing lever is influenced in a clockwise direction by associated spring 166. The stepwise advancement is complete when roller 180 engages the next gear tooth as illustrated in FIG. 12. This brings the advance mechanism to a rest condition with sensing finger fully retracted to allow easy insertion of the next sales form. In addition, the tip of resilient finger 178 is positioned to prevent any significent rotation of the advance gear in a backward direction. This locks the log sheet in place whereby the next information area is held in proper alignment for the next imprint operation.

It will be appreciated that cartridge frame 55 is provided with a bottom opening 192 which generally underlies the advancement mechanism and allows operation of actuation pin 154 to load the mechanism. As mentioned above, the load operation is achieved through movement of the platen carriage toward its home position. End portion 48 of lever 46 extends upwardly into opening 192 for operative engagement with actuation pin 154 as shown in phantom in FIG. 12. Movement of the platen carriage to its home position articulates the level portion 48 to the left of the position shown in phantom in FIG. 2, thererby loading the advance mechanism through movement of the actuation pin 154. This operation brings the advance mechanism to the position illustrated in FIG. 10.

Operation of the data recorder and removable cartridge may be summarized as follows. With the cartridge mounted in place in imprinter 24, a sales form or formset 60 is inserted with the edge portion thereof underlying overhang gage 188. With a log sheet mounted in the cartridge, the card lock-out mechanism is open, whereby a credit card may be inserted with such being held in place by the above-described release lever 100 and associated mechanism. The print wheel select keys 28 are then set up to reflect the amount of the transaction etc. The platen carriage is then manipulated to the right, whereby the roller platen imprints a single row of information onto the formset and underlying log sheet. The roller platen is automatically shifted to imprint other data onto the formset during the return stroke. Just before the carriage reaches its home position, the advance mechanism is preloaded through movement of lever 46. This automatically rejects the credit card which is returned to the customer. The cartridge is removed from the imprinter and presented to the customer for his signature in a space provided in the formation area. The formset is then removed by the attendant and, preferably, one of the copies is provided to the customer. Upon removal of the formset, the log sheet is automatically advanced to the next position, whereby the next information area is in general alignment with the print area when the cartridge is returned to the imprinter. This sequence of operations is repeated for recording each transaction. When the last information area on the log sheet has been imprinted, the card lock-out mechanism closes the receiving slot to prevent further operation until a new log sheet has been loaded into the cartridge.

From the foregoing description, it will be appreciated that the imprinter and associated cartridge of the present invention provides a highly convenient and foolproof means of recording credit card transactions and the like. Each transaction is recorded on a separate line or information area of the log sheet. The log sheets may be forwarded to a central processing station where they are optically scanned, and the information therefrom used for the preparation of monthly statements or the like. It is not intended that the present invention be limited to the exact imprinter illustrated in FIG. 1. If desired, a platen other than the shifting type may be utilized depending upon the needs of the particular application. It will also be appreciated that while it is intended that the information areas of the log sheet accommodate a single row of data, it is foreseeable that the information area might be widened to accommodate two or more rows of data if required.

While the invention has been particularly shown and described with reference to the preferred embodiment thereof, it will be understood by those skilled in the art that various changes in form and detail may be made therein without departing from the spirit and scope of the invention.

What we claim:

1. A device for carrying an elongated record sheet having a plurality of transversely extending record areas, each adapted to receive printed information when brought into alignment with a print area, said device comprising:

a housing, a take-up spool mounted for rotation in said housing to advance the record sheet, means for fastening the record sheet to said take-up spool, index stop means associated with said housing for preventing advance rotation of said take-up spool beyond a predetermined angular position whereby one of the record areas is brought into general alignment with the print area, means for selectively releasing said index stop means to allow further rotation of said take-up spool beyond said predetermined angular position whereby another of the record areas may be brought into general alignment with the print area, said housing comprising first and second portions, said second portion being movable relative to said first portion between open and closed positions, said release means being responsive to movement of said second portion toward said closed position to release said index stop means.

2. A device for carrying an elongated record sheet having a plurality of transversely extending record areas, each adapted to receive printed information when brought into alignment with a print area, said device comprising:

a housing, a take-up spool mounted for rotation in said housing to advance the record sheet, means for fastening the record sheet to said take-up spool, index stop means associated with said housing for preventing advance rotation of said take-up spool beyond a predetermined angular position whereby one of the record areas is brought into general alignment with the print area, means for selectively releasing said index stop means to allow further rotation of said take-up spool beyond said predetermined angular position whereby another of the record areas may be brought into general alignment with the print area, said housing including a lid movable between an open position for loading the record sheet and a closed position, said release means being responsive to movement of said lid toward said closed position to release said index stop means.

3. A device carrying an elongated record sheet having a pluraity of transversely extending record areas, each adapted to receive printed information when brought into alignment with a print area, said device comprising a housing, a take-up spool mounted for rotation in said housing to advance the record sheet, means for fastening the record sheet to said take-up spool, index stop means associated with said housing for preventing advance rotation of said take-up spool beyond a predetermined angular position whereby one of the record areas is brought into general alignment with the print ara, means for selectively releasing said index stop means to allow further rotation of said take-up spool beyond said predetermined angular position whereby another of the record areas may be brought into general alignment with the print area, and actuation means for controlled advancement of the record sheet and clutch means engageable with said actuation means to connect such to said take-up spool for advancement thereof.

4. The device set forth in claim 3 wherein said housing includes a lid movable between an open position to allow loading of the record sheet and a closed position, said clutch means being engaged with said actuation means in response to movement of said lid toward said closed position.

5. The device set forth in claim 4 wherein said release means is responsive to movement of said lid toward said closed position to release said index stop means.

6. A device for carrying a transaction record form and an elongated record sheet having a plurality of transversely extending record areas, each adapted to receive printed information when brought into alignment with a print area, said device comprising:

means for receiving the transaction record form at a predetermined location, means for sensing the presence of the record form at said location, and advancement means operatively connected to said sensing means and responsive thereto upon removal of the record form from said location for advancing the record sheet a predetermined increment to bring a different record area into alignment with the print area.

7. The device set forth in claim 6 wherein said advancement means includes a stored energy mechanism and means normally holding said mechanism against movement and being released in response to said sensing means upon removal of the form from said location whereby a different record area is brought with alignment with the print area.

8. The device set forth in claim 7 wherein said advancement means includes actuation means for preloading said stored energy mechanism in response to completion of a print operation.

9. A device for use with a data recorder imprinter to record embossed data from a card onto an elongated record sheet having a plurality of transversely extending record areas, said device comprising:

housing means, means associated with said housing means for retaining a card bearing embossed dats to be printed in one of the record areas, means carried by said housing means including a stored energy mechanism for advancing the record sheet a predetermined increment, actuation means operative to pre-load said mechanism in response to a print operation, and means for releasing the card from said card receiving means, said release means being responsive to operation of said actuation means when pre-loading said stored energy means.

10. The device set forth in claim 9 further including means associated with said release means for manually releasing the card independently of operation of said actuation means.

11. The device set forth in claim 9 wherein said release means includes means for ejecting the card from said card receiving means in response to operation of said actuation means.

12. The device set forth in claim 11 further including means associated with said ejecting means for manually ejecting the card independently of operation of said actuation means.

13. An apparatus for recording data on an elongated record sheet, said apparatus comprising:

housing means, imprint means including a carriage mounted to said housing means and movable along a path to effect an imprint operation along a print area, cartridge means removably mounted to said housing means, an elongated record sheet mounted by said cartridge means and extending between a storage location and a takeup location, said sheet having a plurality of transversely extending information areas each adapted to be imprinted when brought into alignment with said print area, and advance means associated with said cartridge means and operative to incrementally advance said record sheet, said advance means including an advance member operatively connected to a portion of said record sheet, stored energy means operative upon release to advance said advance member, actuation means responsive to operation of said carriage for loading said stored energy means, and means for selectively releasing said stored energy means whereby said record sheet is advanced a predetermined increment by said advance member.

14. The apparatus set forth in claim 13 wherein said cartridge means further includes means for retaining a card bearing embossed data in general alignment with said print area, and means responsive to operation of said actuation means for releasing the card from said retaining means.

15. The apparatus set forth in claim 14 wherein said card release means includes means for manually releasing the card independently of operation of said actuation means.

16. The apparatus set forth in claim 13 wherein said cartridge means further includes means for receiving a transaction form, and means for sensing the presence of said transaction form in said form receiving means, said stored energy release means being responsive to said sensing means to effect operation of said advance member by said energy storage means when the transaction form is removed from said receiving means.

17. The apparatus set forth in claim 13 wherein said cartridge means further includes means for receiving a card bearing embossed data in general alignment with said print area, and lockout means responsive to the absence of said record sheet at a predetermined location between said storage and take-up locations to prevent insertion of a card in said receiving means.

18. The apparatus set forth in claim 17 wherein said cartridge means further includes eject means responsive to operation of said actuation means for ejecting the card from said receiving means.

19. A transaction data recording apparatus for printing data along a print area, said apparatus comprising:

housing means, imprint means including a carriage connected to said housing means and reciprocally movable in forward and reverse directions along a path from a home position and back to effect an imprint operation along the print area, means for retaining a card bearing embossed data in a print position whereby the embossed data is in said print area, and release means for releasing said retaining means from holding the card in said print position, said release means including first means responsive to movement of said carriage for causing release of said retaining means after imprinting of said embossed data during an imprint operation, said release means including second means for manually releasing said retaining means independently of said carriage operation.

20. The apparatus set forth in claim 19 wherein said release means comprises means for causing ejection of the card from said print position.

21. The apparatus set forth in claim 20 wherein said first means is responsive to operation of said carriage for causing ejection of the card from said print position.

22. The apparatus set forth in claim 21 wherein said second means includes means for manually causing ejection of the card from said print position.

23. The apparatus set forth in claim 19 wherein said first means is operative in response to return of said carriage toward said home position after completion of a said imprint operation along the print path.

24. The apparatus set forth in claim 19 wherein said embossed data is imprinted on movement of said carriage in said forward direction.

25. An apparatus for recording data on an elongated record sheet, said apparatus comprising:

housing means, imprint means including a carriage mounted to said housing means and movable along a path to effect an imprint operation in a print area, a cartridge removably mounted to said housing means, an elongated record sheet carried by said cartridge and extending between a storage location and a takeup location, said sheet having a plurality of transversely extending information areas each adapted to be imprinted when brought into general alignment with said print area, and means enabled by operation of said imprint means for advancing said record sheet to bring the next said information area into general alignment with print area.

said cartridge including card receiving means for holding a card bearing embossed data generally within said print area and means for inhibiting said card receiving means from holding a card's embossed data within said print area after an imprint operation has been performed unless said advancing means has been subsequently operated.

26. The apparatus set forth in claim 25 wherein said card receiving means includes a card retention means movable between a card holding position and a card release position, said inhibit means causing movement of said card retention means to said release position in response to completion of an imprint operation.

* * * * *

UNITED STATES PATENT AND TRADEMARK OFFICE

CERTIFICATE OF CORRECTION

PATENT NO. : 4,059,051

DATED : November 22, 1977

INVENTOR(S) : John A. Maul and Richard E. Valentine

It is certified that error appears in the above-identified patent and that said Letters Patent are hereby corrected as shown below:

Column 6, line 8, "th" should be deleted and "the" substituted therefor.

Column 7, line 65, "associted" should be deleted and "associated" substituted therefor.

Signed and Sealed this

*First* Day of *August 1978*

[SEAL]

*Attest:*

RUTH C. MASON
*Attesting Officer*

DONALD W. BANNER
*Commissioner of Patents and Trademarks*